US005522297A

United States Patent [19]

Enserink

[11] Patent Number: 5,522,297

[45] Date of Patent: Jun. 4, 1996

[54] TREMOLO APPARATUS PIVOTABLE ABOUT AN ADJUSTABLE PIVOTING AXIS

[75] Inventor: Anton R. Enserink, Wassenaar, Netherlands

[73] Assignee: Enserink Innovation B.V., Wassenaar, Netherlands

[21] Appl. No.: 256,516

[22] PCT Filed: Jan. 8, 1993

[86] PCT No.: PCT/NL93/00006

§ 371 Date: Aug. 31, 1994

§ 102(e) Date: Aug. 31, 1994

[87] PCT Pub. No.: WO93/14490

PCT Pub. Date: Jul. 22, 1993

[30] Foreign Application Priority Data

Jan. 9, 1992 [NL] Netherlands ..... 9200030

[51] Int. Cl.[6] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 4,541,320 | 9/1985 | Sciuto | 84/267 |
| 4,742,750 | 5/1988 | Storey | 84/313 |
| 4,787,285 | 11/1988 | Goto | 84/313 |
| 5,359,144 | 10/1994 | Benson | 84/313 |

FOREIGN PATENT DOCUMENTS

| | | |
|---|---|---|
| 3543583 | 6/1987 | Germany . |
| 3832127 | 11/1990 | Germany . |
| WO86/02188 | 4/1986 | WIPO . |

*Primary Examiner*—Steven L. Stephan
*Assistant Examiner*—Cassandra C. Spyrou
*Attorney, Agent, or Firm*—Young & Thompson

[57] ABSTRACT

Tremolo apparatus for a stringed instrument, provided with a baseblock (103) for anchoring strings (108), a first knife edge bearing (106/131; 166/153) defining a first pivot point, and a second knife edge bearing (107/130; 165/152) defining a second pivot point. The first and second pivot points define together a pivot axis (X) for the baseblock (103). The baseblock (103) is provided with a series of string guide elements. A first outer string guide element (104) is located a first predetermined distance away from the first pivot point, and a second string guide element (104) is located a second predetermined distance away from the second pivot point. The first and second knife edge bearings are arranged in such a way that the first distance and the second distance are adjustable independently from one another.

8 Claims, 4 Drawing Sheets fig-1
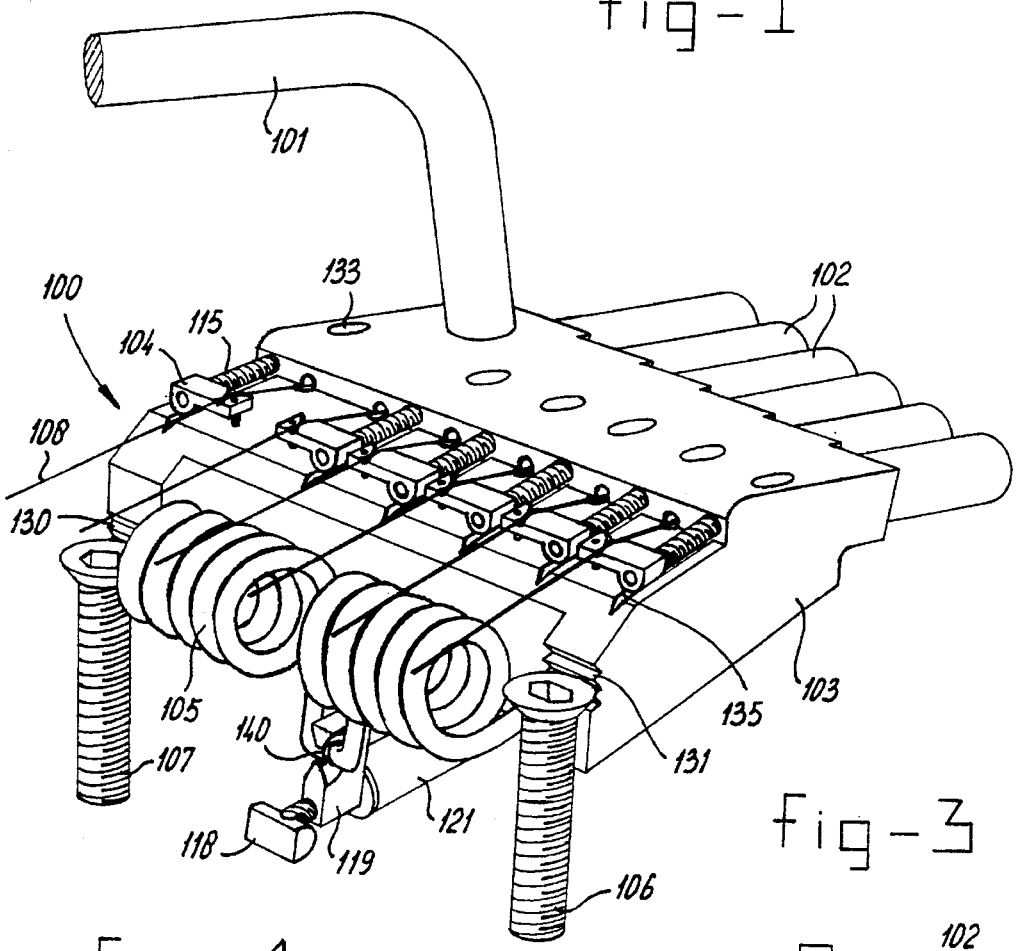
fig-3
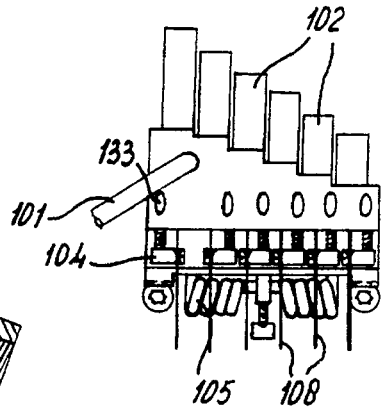
fig-4
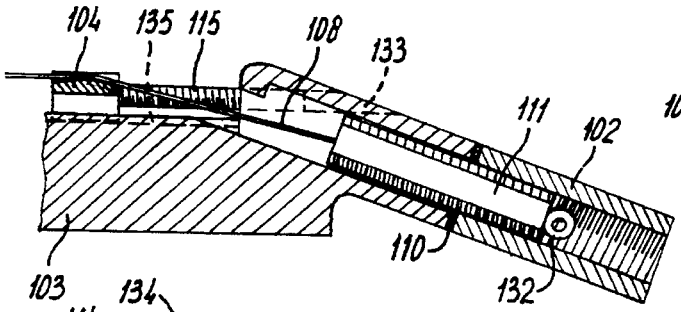
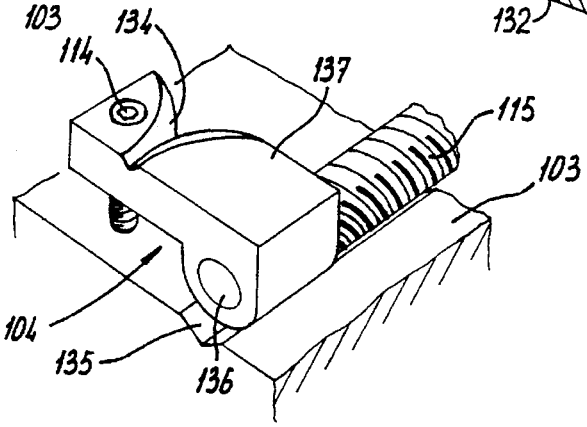
fig-5

TREMOLO APPARATUS PIVOTABLE ABOUT AN ADJUSTABLE PIVOTING AXIS

FIELD OF INVENTION

The invention relates to a tremolo for a stringed instrument, including at least a baseblock for anchoring strings, which baseblock can pivot about fulcrums, which fulcrums together define a pivoting axis, about which the baseblock can pivot, which pivoting axis has a predetermined angle relative to a plane determined by the strings.

BACKGROUND OF THE INVENTION

A tremolo having such an angled pivoting axis is known from U.S. Pat. No. 4,632,005. This known tremolo consists of a bridge to which several roller-equipped saddles are mounted, which bridge is firmly mounted to the body of the stringed instrument, and a tailpiece pivotable about a fixed angled pivoting axis, to which tailpiece the strings are anchored.

The string tension of the plurality of strings is in balance about the pivoting axis with a tremolo spring, whereas the tremolo is activated by exercising a pulling or pushing force on a lever (hereinafter referred to as: tremolo-arm). So, the tailpiece pivots and a corresponding increment or decrement of the tension and the pitch of each string is achieved, the strings moving on rollers in the saddles. The movement of strings on the rollers can cause friction, particularly when wear and corrosion occur in the bearing of these rollers. Moreover, the bearing of the pivoting axis in the known tremolo comprises an axis and a hole. It is known that such a bearing has much more friction than for instance a knife edge bearing. Furthermore, the known apparatus is equipped with a compression type coil spring as tremolo spring, which about an arm counter-balances the string tension. This construction is not statically determined, so that undesired deformation and friction can occur.

The occurrence of friction in the tremolo movement is a problem, because the tremolo will not always return to the same neutral position, causing the stringed instrument to sound out of tune.

In addition, the angle of the pivoting axis is determined, so that it is hardly possible to set the amount of pushing or pulling force on the tremolo arm relative to the tremolo effect (hereafter referred to as: tremolo action) precise and within an adequate range. Particularly, when using a heavier string gauge the action of the known tremolo cannot be set deep enough.

The known tremolo further is supplied with the feature that the distance between the anchoring point of each string and the pivoting axis can be adjusted in order to facilitate a very precise compensation of the different stretch characteristics of each string, with the objective to maintain the relative tonal intervals between the strings when using the tremolo.

When adjusting to the exact stretch characteristics the problem occurs that it is very difficult to achieve any sensible adjustment, for instance, when mounting a different string type. Also the stretch characteristics of the strings change rather quick due to aging and loss of elasticity.

This known tremolo apparatus is only suitable for guitars with an open back, in which at the rear side, viewed from the neck of a stringed instrument, no part of the body may be found.

To manufacture a working version of this known tremolo, a complex, expensive and bulky construction is necessary.

SUMMARY OF THE INVENTION

The invention has the objective to eliminate the aforesaid disadvantages.

For that purpose the tremolo in a preferred embodiment of the invention is characterized in that the fulcrums consist of at least two knife edge bearings, being adjustable in such a way, that the position of the pivoting axis relative to the plane, determined by the strings, as well as the angle between the pivoting axis and said plane can be adjusted variably.

In a preferred embodiment the tremolo according to the invention includes string guiding means for each string, characterized in that the knife edge bearings consist of first groove-shaped means on the baseblock and a first fulcrum bolt being adjustable in height, of which a sharp-edged head in operation interacts with the first groove-shaped means, and of second groove-shaped means on the baseblock and a second fulcrum bolt being adjustable in height, of which a sharp-edged head in operation interacts with the second groove-shaped means, which first and second groove-shaped means each comprise a series of grooves comprising at least one groove, one series of grooves being positioned further away from string guiding means fixed to the baseblock than the other series of grooves in such a way that the high strings undergo a longer pivoting travel way than the low strings. Utilizing such a construction, a somewhat angled pivoting axis is obtained, without the occurrence of the aforesaid problematic friction of strings in the saddles.

It may be noted that utilizing two fulcrum belts in a tremolo, which are adjustable in height and mounted to the body of a stringed instrument, is known per se from U.S. Pat. No. 4,171,661. With this apparatus, however, it is not possible to either set the angled pivoting axis or the variable pivoting arm. Also, the sharp edged head of the bolt is not used to create a sharply defined fulcrum.

In yet another preferred embodiment the tremolo according to the invention is characterized in that the knife edge bearings consist of knife means continuously adjustable in height relative to the baseblock, the knife means interacting with means continuously adjustable in height, the means having a V-shaped slot, and being mounted to the body of the stringed instrument.

In another preferred embodiment of the invention the string guiding means are saddles and the height of each individual saddle relative to the baseblock is individually adjustable with a height adjustment screw.

In yet another preferred embodiment the invention is characterized in that each saddle individually is movable in grooves in the baseblock, which grooves are aligned with the strings, and each saddle can be translated along the groove using a string length adjustment screw. Thus, a very rigid saddle construction is achieved.

In yet another preferred embodiment the invention is characterized in that each string length adjustment screw has a thread, interacting with its own threaded hole in the baseblock in such a way, that the string length adjustment screws can be adjusted through openings in the side of the baseblock opposite the strings. By these measures the string length adjustment screws can be easily adjusted without the strings hindering the user.

In another preferred embodiment the tremolo according to the invention is characterized in that the tremolo spring is a torsion spring, placed inside a cavity in the baseblock. Thus, the tremolo can be made with a compact and resonance-free structure. It may be noted that the use of a torsion spring for a tremolo is known per se from the German Offenlegungschrift 3,543,583. However, the apparatus presented in this publication does not include the tremolo spring in a cavity of a baseblock, and thereby does not contribute to a compact structure.

From the European patent publication 0,157,419 a saddle for a string being adjustable in height and along the string is known per se. However, the string length adjustment screws are not well accessible for the user. Moreover, the saddles used are-not fixed sideways.

BRIEF DESCRIPTION OF THE DRAWINGS

The invention will be further explained referring to the drawings, which are only meant as illustration and not as a restriction of the scope of the invention. In the drawings:

FIG. 1 shows a perspective view of the tremolo according to the invention, designed for guitars with an open back;

FIG. 3 shows a top view of the tremolo;

FIG. 4 shows a string tuning knob;

FIG. 5 shows one of the string saddles attached to the tremolo;

DESCRIPTION OF THE PREFERRED EMBODIMENTS

Figure 2:
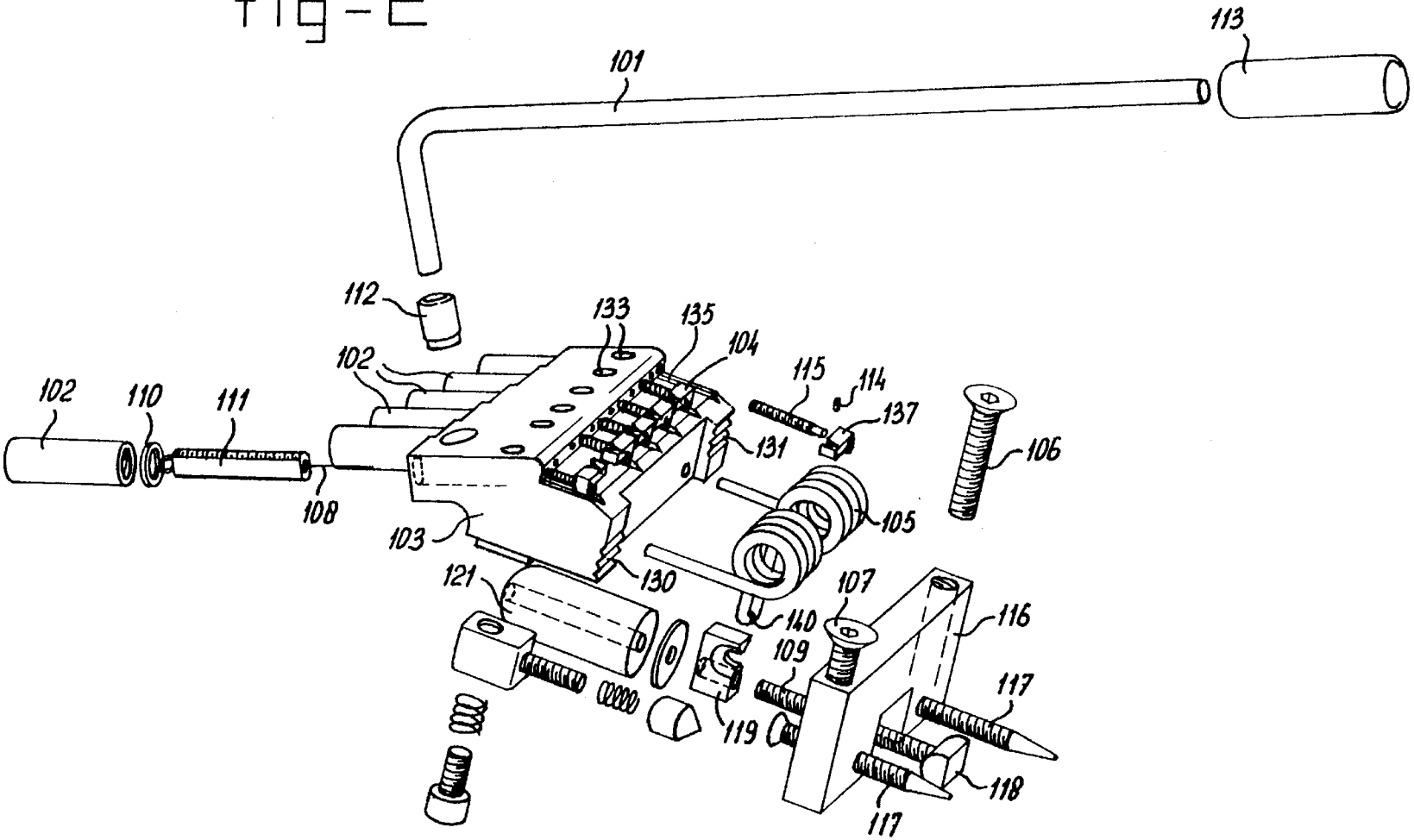
FIG. 2 shows an exploded perspective view of the tremolo showing its basic components.

The tremolo according to the invention will first be described referring to FIGS. 1 and 2. An opening is made in a baseblock 103, in which opening tremolo arm 101 can be inserted. The opening can be provided with a ring 112, whereas the tremolo-arm 101 at its end may be provided with a knob 113. Furthermore, the tremolo is provided with tuning knobs 102, one for each string 108. Referring to FIG. 4 the construction of the tuning knob 102 will be further explained. The strings 108 are lead over the saddles 104, shown enlarged in FIG. 5, through appropriately dimensioned openings in baseblock 103 to the tuning knobs 102.

The baseblock is connected to the ends of a torsion spring 105, being connected in its center 140 to a fulcrum block 116 by a bolt 109. The center 140 of the torsion spring 105 is seizingly held by a hook 119 that can slide over a bolt 109. The head 118 of this bolt 109 is shaped in such a way that bolt 109, when placed in the fulcrum block 116, can rotate with the movement of the spring. A spring adjustment knob 121 is placed at the end of bolt 109. By turning the spring adjustment knob 121 the center 140 of spring 105 can be displaced relative to the fixed fulcrum block 116 parallel to bolt 109, and spring 105 can, therefore, be loaded to an initial tension, and this initial tension can be adjusted easily.

The fulcrum block 116 is firmly mounted to the body of the stringed instrument (not shown) by bolts 117. On top of the fulcrum block 116 and opposing each other two fulcrum bolts 106, 107 are placed. The fulcrum bolts could also be placed in separate retainers or even directly in the body of the guitar. The distance between both fulcrum bolts 106,107 corresponds to the distance between the groove-shaped means 130 and 131 on the baseblock 103. Both fulcrum bolts 106, 107 are adjustable in height independently from each other. Both fulcrum bolts 106, 107 have a round, sharp edge with a larger diameter than the thread. The sharp edge of fulcrum bolt 106 is in contact with and interacts with one of the three V-shaped grooves 131 in baseblock 103, whereas the sharp edge of the head of fulcrum bolt 107 is in contact with one of the three V-shaped grooves 130 in baseblock 103. The choice for a sharp edge interacting with V-shaped grooves brings about, that the friction and, consequently, the wear during operation of the tremolo is minimal, however, this is not essential to the invention. The invention is neither limited to three V-shaped grooves. In principle, the invention can be applied with any number greater than one. Also a continuously variable fulcrum is possible, as will be described later on referring to FIG. 6. The grooves 131 are positioned closer to the nearest string than the grooves 130, in such a way, that the baseblock 103 executes an asymmetric, angled pivotal movement with respect to the fixed fulcrum block 116 during activation of the tremolo. When the bass strings are anchored at the side of the baseblock 103 with the grooves 131 and the high strings are anchored at the other side with grooves 130, the pivot arm length about which the strings turn increases from the heaviest to the lightest string gauge. Thus, it is accomplished, that the pitch decrement or increment of all strings is more in the same order than is possible with traditional tremolos. Also, loss of the tone of a bass string can be prevented, because the tension in this string does not drop to such an extent, that the bass string contacts the normally applied magnetic guitar pick-up. With these traditional tremolos the pitch decrement of the high E string with a 0.225 mm gauge is 4 times a semitone, while the apparatus according to the invention can reach a pitch drop of one entire octave.

The exact pitch decrement or increment per string depends on the arm length about which each string is pivotally rotated and consequently on the point of contact between grooves 131 and fulcrum bolt 106, or grooves 130 and fulcrum bolt 107 respectively. Both points of contact mentioned above depend on the choice of one of the three grooves 130, 131 respectively in which the sharp edge of the head of fulcrum bolt 107, 106 respectively is positioned initially. By predetermining with which of the three grooves 130, 131 respectively the fulcrum bolt 107, 106 respectively has to interact, a global adjustment and action of the tremolo is determined. With anchored and laid strings 108 a further global and precise adjustment can be achieved by adjusting the height of fulcrum bolts 106, 107 and saddles 104, respectively, as will be explained hereinafter. Each user, therefore, can set a light or heavy tremolo action to his or her own taste, and correct the precise pitch decrement or increment by activation of the tremolo.

The tuning mechanism will be explained referring to FIGS. 3 and 4. A tuning knob 102 belongs to each string 108. Inside each tuning knob 102 a string guide 111 is placed provided with an opening through which the string 108 is guided. In operation, the string (ball) end 132 of the string is positioned inside the tuning knob 102 and it is dimensioned such, that it cannot slip into said opening in the string guide 111. The string guide 111 has at least one flattened side which interacts with the opening in the baseblock 103, through which the string 108 and the string guide 111 are fed, in such a way that the string guide cannot turn relative to baseblock 103. Moreover, the string guide is provided with an outside thread that interacts with an inside thread inside the tuning knob. By turning the tuning knob the string can be relaxed or laid tighter in order to tune it to the right pitch. The successive tuning knobs are preferably displaced relative to each other, as shown in FIG. 3, in such a way that tuning a string is not obstructed by the adjacent tuning hobs, or that tuning a string leads to unintentional turning of an adjacent tuning knob resulting in detuning of an adjacent string.

In the construction shown in FIG. 4 the tuning knob 102 rests with a washer 110 on the baseblock 103. It is also-possible to apply means which keep the tuning knob 102 from falling out of the baseblock 103 when string 108 breaks.

FIG. 5 shows a saddle 104 over which a string 108 can be guided. FIGS. 1,2 and 3 show the positions of the saddles 104 on the tremolo, while in FIG. 2 the three parts of the saddle are shown: a saddle block 137, a height adjustment screw 114 and a string length adjustment screw 115. When the saddle 114 is mounted of tremolo, the string length adjustment screw 115 is inserted in opening 133 (FIGS. 2 and 3) on top of baseblock 103. The saddle block 137 is placed partially in a V-shaped groove 135, in order to prevent it from movement perpendicular to the string. The string length adjustment screw 115 is placed into a threaded hole 136 in the saddle block 137. Using an allen key or a small screwdriver the string length adjustment screw 115 can easily be adjusted through opening 133, so that the saddle block 137 can easily be adjusted in the direction of the string. On the side of the saddle block opposite the string length adjustment screw, a guiding recess 134 for string 108 is made. Right next to it height adjustment screw 114 mentioned above is placed. By turning the height adjustment screw 114 the saddle 104 pivots upon the axis of string length adjustment screw 115. Consequently, the guiding recess 134 for string 108 can be adjusted beth in height and longitudinally to the string. The construction shown here is easy to manufacture, reliable and solid. At the same time, the construction is very compact, without the anchored strings hindering any adjustment of the saddles 104: the necessary tools can be easily guided past the strings without touching them. It is observed that opening 136 in saddle 104 does not have to be threaded. It is also possible that the string length adjustment screw is threaded over its full length, which thread interacts with a thread inside opening 133 of base-block 103, while the string length adjustment screw 115 is clinched revolving into saddle 104.

The height of each string is individually adjustable by means of saddle 104. The primary objective is an optimization of the string action, to say the height of the string relative to the neck, which for every player of a stringed instrument is subject to a personal preference. In the present invention the saddles for each string also allow the arm length about which each string pivots by activation of the tremolo to be adjusted individually per string. Therefore, the pitch change by activating the tremolo, because of the design of the saddles 104, has a fine adjustment for each string.

The strings are laid over the neck and a portion of the body of the stringed instrument, and are preferably anchored in the automatic string locking apparatus to the Dutch patent application 9200031.

Figure 6:
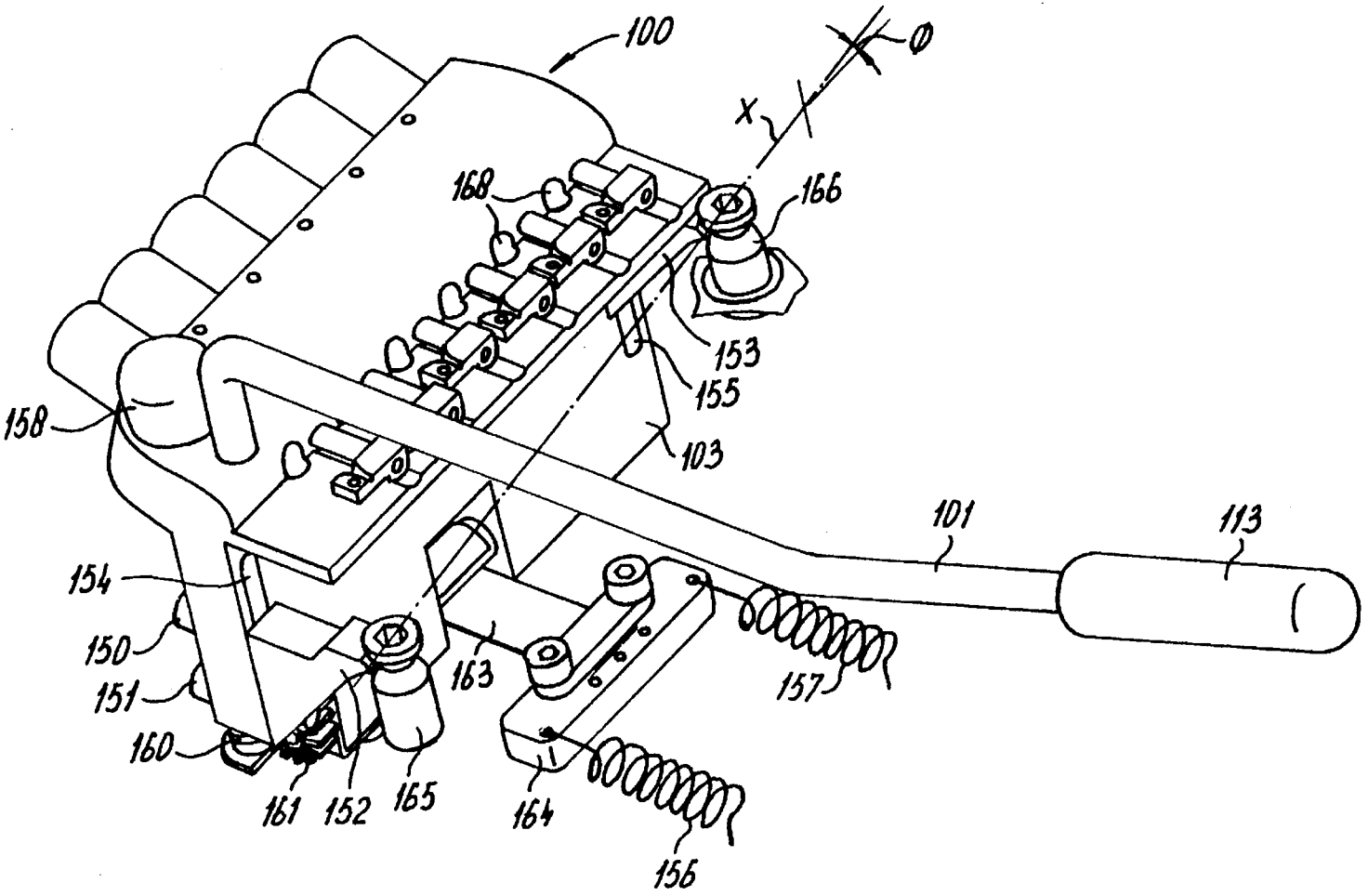
FIG. 6 shows an alternative embodiment of the tremolo, designed for guitars with a closed back.
Figure 7:
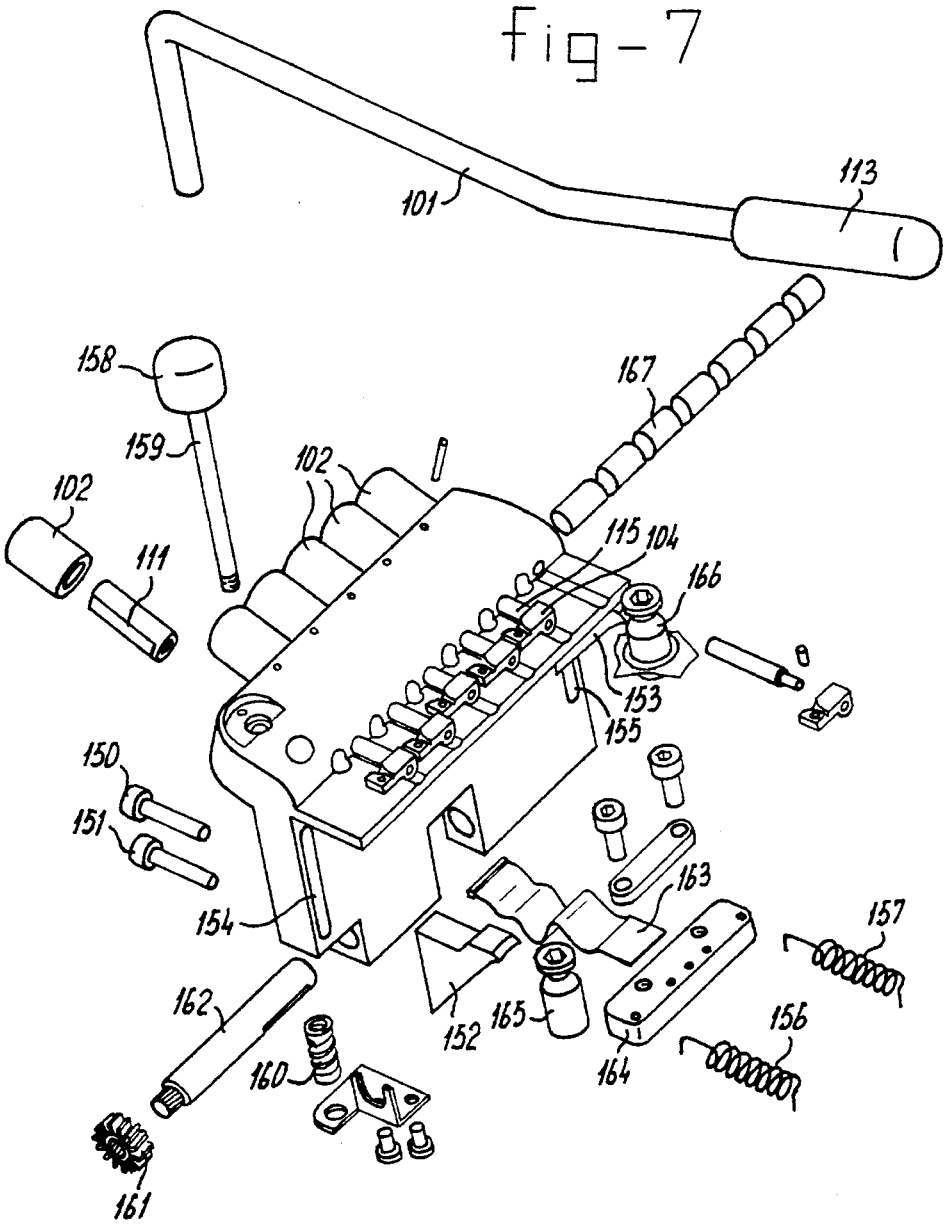
FIG. 7 shows an exploded perspective view of the alternative embodiment according to FIG. 6, showing its basic components of it.

FIGS. 6 and 7 show an alternative embodiment of a tremolo, particularly applicable for guitars with a closed back. FIG. 7 shows the basic components and FIG. 6 shows a tremolo assembled with these components. The pivot points are, as contrasted with the tremolo 100 according to the preceding figures, continuously variable. For that purpose, the locking bolts 150, 151 are mounted through a slotted hole 154 to a knife-edged component 152 of a knife edge bearing, which knife edge bearing further includes a bolt 165 with a V shaped recess, with which the knife-edged component 152 interacts. The position of the knife-edged component 152 in slotted hole 154 is adjustable using locking bolts 150, 151. Bolt 165 is mounted to the body of the stringed instrument (not shown). The length of the portion of the bolt protruding from this body, can be fixed, but, if desired, may be adjustable. On the other side of the baseblock 103 a second slotted hole 155 and a second knife-shaped component 153 interacting with a second bolt 166 with a V-shaped recess are placed. The second knife-edged component 153 is adjustable in height in the slotted hole 155 in the same way as the first knife-edged component 152. Thereto two locking bolts are provided, which are not shown, but are similar to the locking bolts 150, 151 and are attached to the second knife-edged component 153 through slotted hole 155.

The tremolo 100 according to FIGS. 6 and 7 pivots about a line x, defining an angle $\phi$ with the body of the stringed instrument (not shown). This angle $\phi$ is continuously adjustable by adjusting the position of the knife-edged components 152, 153 relative to the slotted hole 154, 155. Furthermore, the position of line x relative to the plane defined by the strings (not shown) laid over saddles 104 is continuously adjustable.

In FIGS. 6 and 7 a construction is shown in which the continuously adjustable components 152, 153 are knife-edged and the fulcrum bolts 165, 166 have V shaped recesses. It will be clear to the expert, that the components 152, 153 movable in slotted holes 154, 155, with the same effect can have V-shaped recesses, while then the fulcrum bolts 165, 166 will include knife-shaped protuberances.

This alternative embodiment also includes a loading device for the tremolo springs 156, 157, adjustable from the front side of the stringed instrument, which tremolo springs in this embodiment are expansion type coil springs. A spring loading knob 158 drives worm 160 through axle 159 (FIG. 7), which is positioned perpendicular to worm gear 161. Worm gear 161 is attached to an axle 162, on which a belt 163 is fixed at one end. By turning the spring loading knob 158 the belt 163 will roll itself around axle 162, thereby pulling a spring holder 164, which is fixed to the other end of the belt 163 towards axle 162, so that springs 156, 157 are loaded. The position of spring loading knob 158 is determined in such a way, that it obstructs neither playing of the stringed instrument nor activation of the tremolo. The preferred transmission rate of worm 160 and worm gear 161 is 1:20.

Figure 8:
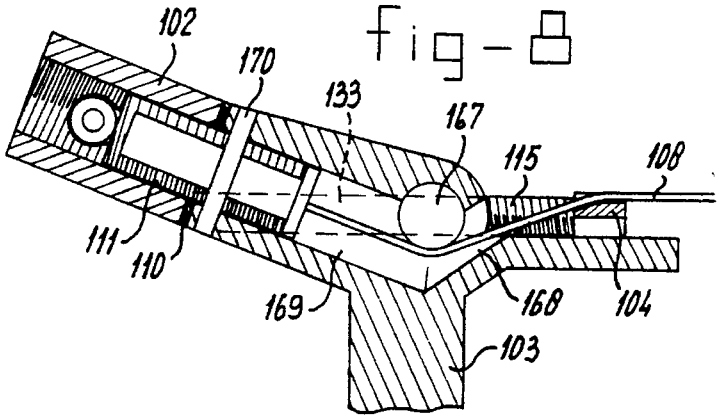
FIG. 8 shows a string tuning knob of the alternative embodiment according to FIG. 6.

FIG. 8 shows an alternative string tuning apparatus for this alternative embodiment. Contrary to the situation in FIGS. 1, 2 and 4 the tuning knobs 102 are placed slightly upwards relative to the front of the stringed instrument. The string 108 is guided underneath a guide 167, which preferably is a hard, smooth cylinder pressed into baseblock 103, and is bent upwards towards saddle 104. The channel 168 made in baseblock 103 is shaped in such a way, that the string 108 will always come out upwards from channel 168, whenever it is put into tuning knob 102 and string guide 111. The string guide 111 is placed in a channel 169 and is locked by a pin 170, so that the string guide cannot fall out of the tremolo apparatus together with tuning knob 102 in case there is no string in it. The string guide 111 consists of a tube, to which an outside thread of preferably M6×0.5 is made up to preferably 1 mm from its end. The threaded surface of this tube is flattened on one side, with the flattened portion extending to preferably 1 mm from the threaded end. Thus, a fully circular threaded portion is inside tuning knob 102, providing precise and smooth operation of the string tuning apparatus.

I claim:

1. Tremolo apparatus for a stringed instrument, comprising a baseblock (103) for anchoring strings (108), a first knife edge bearing (106/131; 166/153) defining a first pivot point, a second knife edge bearing (107/130; 165/152) defining a second pivot point, said first and second pivot points defining together a pivot axis (X) for said baseblock (103), said baseblock (103) being provided with a series of string guide means comprising a first outer string guide means (104) located a first distance away from said first pivot point and a second string guide means (104) located a second distance away from said second pivot point, said first knife edge bearing 106/131; 166/153) including first means 131; 153) for adjusting the first distance independently from the second distance and said second knife edge bearing 107/130; 165/152) including second means (130; 152) for adjusting the second distance independently from the first distance.

2. Tremolo apparatus according to claim 1, further including fulcrum bolt supporting means (116), wherein said first means comprises a first set of at least two grooves (131) on the baseblock (103) and said first knife edge bearing further includes a first fulcrum bolt (106) supported by said fulcrum bolt supporting means (116) and being adjustable in height relative to said fulcrum bolt supporting means (116), said first fulcrum bolt (106) comprising a first sharp-edged head which, in operation, interacts with a selected groove of said first set of at least two grooves (131), and wherein said second means comprises a second set of at least two grooves (130) on the baseblock (103) and said second knife edge bearing further includes a second fulcrum bolt (107) supported by said fulcrum bolt supporting means (116) and being adjustable in height relative to said fulcrum bolt supporting means (116), said second fulcrum bolt (107) comprising a second sharp-edged head which, in operation, interacts with a selected groove of said second set of at least two grooves (130).

3. Tremolo apparatus according to claim 1, further including fulcrum bolt supporting means (116), wherein said first means comprises a first knife shaped element (153) slidably mounted in a first slotted hole (155) in said baseblock (103) and said first knife edge bearing further includes a first fulcrum bolt (166) supported by said fulcrum supporting means (116) and being adjustable in height relative to said fulcrum bolt supporting means (116), said first fulcrum bolt (166) being provided with a first V-shaped recess which, in operation, interacts with said first knife shaped element (153), and wherein said second means comprises a second knife shaped element (152) slidably mounted in a second slotted hole (154) in said baseblock (103) and said second knife edge bearing further includes a second fulcrum bolt (165) supported by said fulcrum supporting means (116) and being adjustable in height relative to said fulcrum bolt supporting means (116), said second fulcrum bolt (165) being provided with a second V-shaped recess which, in operation, interacts with said second knife shaped element (152).

4. Tremolo apparatus according to claim 1, wherein said string guiding means are saddles (104) provided with height adjustment screws (114).

5. Tremolo apparatus according to claim 4, wherein said baseblock (103) is provided with grooves (135) and with string length adjustment screws (115) for translating said saddles (104) along said grooves (135).

6. Tremolo apparatus according to claim 5, wherein said string length adjustment screws (115) are threaded and said baseblock (103) is provided with threaded through openings (133), each of said threaded through openings (133) accommodating one of said string length adjustment screws (115).

7. Tremolo apparatus according to claim 1, further including a tremolo spring, said baseblock (103) having a cavity and said tremolo spring being a torsion spring (105), located inside said cavity.

8. Tremolo apparatus according to claim 1, further including a knob (158), a worm gear (160, 161) connected to said knob, and a tremolo spring comprised of one or more expansion springs (156, 157) connected to said worm gear through third means (162, 163, 164) such that the expansion springs (156, 157) can be loaded by said knob (158).

* * * * *